US009665063B2

(12) United States Patent
Makino et al.

(10) Patent No.: US 9,665,063 B2
(45) Date of Patent: May 30, 2017

(54) IMAGE FORMING APPARATUS

(71) Applicant: CANON KABUSHIKI KAISHA, Tokyo (JP)

(72) Inventors: Masahiro Makino, Tsukubamirai (JP); Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/105,529

(22) PCT Filed: Dec. 15, 2014

(86) PCT No.: PCT/JP2014/083105
§ 371 (c)(1),
(2) Date: Jun. 16, 2016

(87) PCT Pub. No.: WO2015/093427
PCT Pub. Date: Jun. 25, 2015

(65) Prior Publication Data

US 2016/0320746 A1 Nov. 3, 2016

(30) Foreign Application Priority Data

Dec. 19, 2013 (JP) ..... 2013-262770

(51) Int. Cl.
*G03G 15/06* (2006.01)
*G03G 15/043* (2006.01)
(Continued)

(52) U.S. Cl.
CPC ..... *G03G 21/20* (2013.01); *G03G 15/0266* (2013.01); *G03G 21/1814* (2013.01);
(Continued)

(58) Field of Classification Search
CPC ..... G03G 21/20; G03G 15/0266; G03G 21/1814; G03G 15/043; G03G 15/065; G03G 2215/00772; G03G 2215/00776
See application file for complete search history.

(56) References Cited

U.S. PATENT DOCUMENTS 7,974,568 B2 * 7/2011 Yamasaki ..... G03G 15/0131 399/27
2011/0305468 A1 * 12/2011 Fujiwara ..... G03G 15/5041 399/27
2011/0318027 A1 * 12/2011 Willard ..... G03G 15/0848 399/44

FOREIGN PATENT DOCUMENTS

JP 4-63371 A 2/1992
JP 9-218633 A 8/1997
(Continued)

*Primary Examiner* — Gregory H Curran
(74) *Attorney, Agent, or Firm* — Canon USA, Inc. I.P. Division

(57) ABSTRACT

To provide an image forming apparatus capable of suppressing an increase in the cost of a process cartridge and capable of reducing image defects caused by replacement of the process cartridge.

A process cartridge including a charging roller and a developing unit is attachable to and detachable from an image forming apparatus. A development temperature sensor is disposed in the developing unit. An in-device temperature sensor is disposed outside the process cartridge inside the image forming apparatus. In the case where a temperature detected by the development temperature sensor is lower than a temperature detected by the in-device temperature-humidity sensor, a peak-to-peak voltage of an alternating-current voltage applied to the charging roller is set based on the result of detection by the development temperature sensor.

21 Claims, 10 Drawing Sheets

(51) Int. Cl.

| | |
|---|---|
| ***G03G 21/18*** | (2006.01) |
| ***G03G 15/02*** | (2006.01) |
| ***G03G 21/20*** | (2006.01) |

(52) U.S. Cl.

CPC ..... *G03G 15/043* (2013.01); *G03G 15/065* (2013.01); *G03G 2215/00772* (2013.01); *G03G 2215/00776* (2013.01)

(56) References Cited

FOREIGN PATENT DOCUMENTS

| | | | |
|---|---|---|---|
| JP | 2001-034036 | A | 2/2001 |
| JP | 2008-191620 | A | 8/2008 |
| WO | 2014/077416 | A1 | 5/2014 |

* cited by examiner

FIG. 5

| IN-DEVICE MOISTURE CONTENT [g/KgDryAir] | DIRECT-CURRENT CHARGING VOLTAGE [V] |
|---|---|
| 0.86 | −710 |
| 1.73 | −704 |
| 5.8 | −680 |
| 8.9 | −660 |
| 15 | −630 |
| 18 | −620 |
| 21.6 | −610 |

IMAGE FORMING APPARATUS

TECHNICAL FIELD

The present invention relates to an image forming apparatus that employs an electrophotographic process.

BACKGROUND ART

In recent years, as charging methods of charging a photosensitive member in an image forming apparatus that employs an electrophotographic process, for example, methods of charging a photosensitive member by causing a charging member as charging means, such as a charging roller, to charge it while being in contact with or adjacent to a surface of the photosensitive member have been known.

One known example of such charging methods is a DC charging method of charging a charging member by applying a charging voltage solely consisting of a direct-current voltage to it. Another known example is an AC charging method of charging a charging member by applying a charging voltage in which a direct-current voltage and an alternating-current voltage are superimposed to it, converging a potential of a surface of a photosensitive member to a direct-current voltage value of the charging voltage applied to the charging member, and thus improving uniformity of the charging potential in the surface of the photosensitive member.

However, with variations in a resistance value caused by temperature changes in the charging member, such as the charging roller, the amount of a discharge current between the charging member and the photosensitive member varies. For example, in the case where the temperature of the charging member declines, the amount of the discharge current between the charging member and the photosensitive member may become insufficient and the charging potential of the surface of the photosensitive member may suffer from charging unevenness. For example, in the case where the temperature of the charging member rises, the amount of the discharge current between the charging member and the photosensitive member may become excessive, the generation of discharge products may increase, and image deletion may easily occur.

As described in Patent Literature 1, disposing a temperature sensor inside an image forming apparatus and controlling a charging voltage applied to a charging member based on a result of detection by the temperature sensor is known.

However, even in the case where the charging voltage is controlled based on the result of detection by the temperature sensor disposed inside the image forming apparatus, as described in Patent Literature 1, for example, if the charging member as at least part of a process cartridge as a unit is replaceable, a temperature detected by the in-device temperature sensor may differ from a real temperature of the charging member immediately after replacement of the charging member.

For example, in the case where a process cartridge retained in low-temperature environments in winter is newly attached to the image forming apparatus, the temperature of the charging member may be lower than the temperature inside the image forming apparatus, the amount of the discharge current between the charging member and the photosensitive member may become insufficient, and the charging potential of the surface of the photosensitive member may suffer from charging unevenness.

CITATION LIST

Patent Literature

PTL 1: Japanese Patent Laid-Open No. 2008-191620
PTL 2: Japanese Patent Laid-Open No. 9-218633

SUMMARY OF INVENTION

Technical Problem

As illustrated in Patent Literature 2, a developing device included in a process cartridge may include a temperature sensor with the aim of detecting the temperature of the environment where toner is contained and of setting recording conditions, such as development contrast or Vback. In this case, if an additional temperature sensor is provided to the charging member with the aim of sensing the temperature of the charging member, this raises a problem in that the cost of the process cartridge increases.

It is an object of the present invention to provide an image forming apparatus capable of suppressing an increase in the cost of a process cartridge by using a temperature sensor disposed in a developing device in setting at least one of the amount of exposure by an exposing device and a development voltage and setting a charging voltage and capable of reducing charging unevenness occurring in the case where a temperature of a charging member is made lower than a temperature inside the image forming apparatus by replacement of the process cartridge.

Solution to Problem

An image forming apparatus according to a first aspect of the present invention includes a photosensitive member, a charging member configured to charge the photosensitive member while being in contact with or adjacent to a surface of the photosensitive member, an exposing device configured to expose the surface of the photosensitive member charged by the charging member and configured to form an electrostatic image thereon, a developing device configured to develop the electrostatic image formed on the surface of the photosensitive member by the exposing device with toner and configured to form a toner image on the surface of the photosensitive member, a transferring device configured to transfer the toner image formed on the surface of the photosensitive member by the developing device to a recording material, a fixing device configured to fix the toner image on the recording material transferred to the recording material by the transferring device by heating and pressing the toner image, a charging power supply configured to apply a charging voltage to the charging member, a development power supply configured to apply a development voltage to the developing device, and a housing that houses at least the photosensitive member, the charging member, the developing device, and the fixing device therein. At least the charging member and the developing device form a unit integrally attachable to and detachable from a main body of the image forming apparatus. The image forming apparatus further includes a first temperature sensor disposed in the developing device and configured to detect a temperature, a first adjusting portion configured to adjust at least one of an amount of exposure by the exposing device and the development voltage based on a result of detection by the first temperature sensor, a second temperature sensor disposed inside the housing and configured to detect a temperature, and a second adjusting portion configured to adjust the charging voltage applied by the charging power supply. The second adjusting portion is configured to adjust the charging voltage based on the result of detection by the first temperature sensor in a case where the temperature detected by the first temperature sensor is lower than the temperature detected by the second temperature sensor and configured to adjust the charging voltage based on a result of detection by the second temperature sensor in a case where the temperature detected by the first temperature sensor is higher than the temperature detected by the second temperature sensor.

An image forming apparatus according to a second aspect of the present invention includes a photosensitive member, a charging member configured to charge the photosensitive member while being in contact with or adjacent to a surface of the photosensitive member, an exposing device configured to expose the surface of the photosensitive member charged by the charging member and configured to form an electrostatic image thereon, a developing device configured to develop the electrostatic image formed on the surface of the photosensitive member by the exposing device with toner and configured to form a toner image on the surface of the photosensitive member, a transferring device configured to transfer the toner image formed on the surface of the photosensitive member by the developing device to a recording material, a fixing device configured to fix the toner image on the recording material transferred to the recording material by the transferring device by heating and pressing the toner image, a charging power supply configured to apply a charging voltage to the charging member, a development power supply configured to apply a development voltage to the developing device, and a housing that houses at least the photosensitive member, the charging member, the developing device, and the fixing device therein. At least the charging member and the developing device form a unit integrally attachable to and detachable from a main body of the image forming apparatus. The image forming apparatus further includes a first temperature sensor disposed in the developing device and configured to detect a temperature, a first adjusting portion configured to adjust at least one of an amount of exposure by the exposing device and the development voltage based on a result of detection by the first temperature sensor, a second temperature sensor disposed inside the housing and configured to detect a temperature, and a second adjusting portion configured to adjust the charging voltage applied by the charging power supply. The second adjusting portion is configured to adjust the charging voltage based on the result of detection by the first temperature sensor in a case where a value obtained by subtracting the temperature detected by the first temperature sensor from the temperature detected by the second temperature sensor is larger than a predetermined value and configured to adjust the charging voltage based on a result of detection by the second temperature sensor in a case where the value obtained by subtracting the temperature detected by the first temperature sensor from the temperature detected by the second temperature sensor is smaller than the predetermined value.

An image forming apparatus according to a third aspect of the present invention includes a photosensitive member, a charging member configured to charge the photosensitive member while being in contact with or adjacent to a surface of the photosensitive member, an exposing device configured to expose the surface of the photosensitive member charged by the charging member and configured to form an electrostatic image thereon, a developing device configured to develop the electrostatic image formed on the surface of the photosensitive member by the exposing device with toner and configured to form a toner image on the surface of the photosensitive member, a transferring device configured to transfer the toner image formed on the surface of the photosensitive member by the developing device to a recording material, a fixing device configured to fix the toner image on the recording material transferred to the recording material by the transferring device by heating and pressing the toner image, a charging power supply configured to apply a charging voltage to the charging member, a development power supply configured to apply a development voltage to the developing device, and a housing that houses at least the photosensitive member, the charging member, the developing device, and the fixing device therein. At least the charging member and the developing device form a unit integrally attachable to and detachable from a main body of the image forming apparatus. The image forming apparatus further includes a first temperature sensor disposed in the developing device and configured to detect a temperature, a first adjusting portion configured to adjust at least one of an amount of exposure by the exposing device and the development voltage based on a result of detection by the first temperature sensor, a second temperature sensor disposed inside the housing and configured to detect a temperature, a second adjusting portion configured to adjust the charging voltage applied by the charging power supply, and a sensing portion configured to sense replacement of the unit. The second adjusting portion is configured to adjust the charging voltage based on the result of detection by the first temperature sensor in a case where the replacement of the unit is sensed by the sensing portion and configured to adjust the charging voltage based on a result of detection by the second temperature sensor in a case where the replacement of the unit is not sensed.

Advantageous Effects of Invention

According to the present invention, an increase in the cost of the process cartridge can be suppressed, and charging unevenness occurring in the case where the temperature of the charging member is made lower than the temperature inside the image forming apparatus by replacement of the process cartridge can also be reduced.

BRIEF DESCRIPTION OF DRAWINGS

FIG. 5 is an environment table of set values of a direct-current voltage superimposed on a charging voltage.

DESCRIPTION OF EMBODIMENTS

Figure 1:
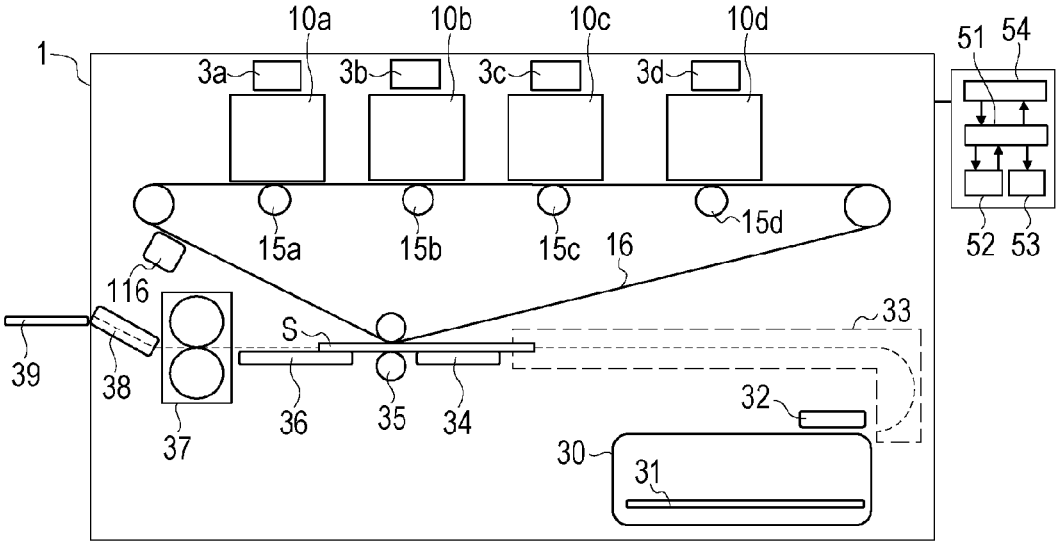
FIG. 1 is a schematic diagram that illustrates an image forming apparatus according to an embodiment.

Embodiments of the present invention are described below with reference to the drawings. Portions with the same reference numerals in the drawings have the same configuration or perform the same function, and redundant description of them is omitted as appropriate. The dimensions, materials, shapes, relative positions, and the like of the components are not intended to limit the scope of applications of the present technical idea to the described ones unless otherwise specified.

First Embodiment

An embodiment of an image forming apparatus according to the present invention is described with reference to the drawings. First, a schematic configuration of the image forming apparatus in general is described by using FIG. 1. After that, the details are described.

About Overall Configuration of Image Forming Apparatus

The schematic configuration of the image forming apparatus is described below. FIG. 1 is an illustration for describing the schematic configuration of the image forming apparatus according to the present embodiment.

An image forming apparatus 1 illustrated in FIG. 1 is a tandem-type image forming apparatus including image forming portions (image forming units) configured to form images corresponding to colors of YMCK and an intermediate transfer member. A plurality of image forming portions 10*a* to 10*d* are arranged in parallel above an intermediate transfer belt as the intermediate transfer member. All the four stations of the image forming portions 10*a* to 10*d* in the present embodiment have the same configuration and are configured to form images (toner images) corresponding to yellow, magenta, cyan, and black, respectively.

Figure 2:
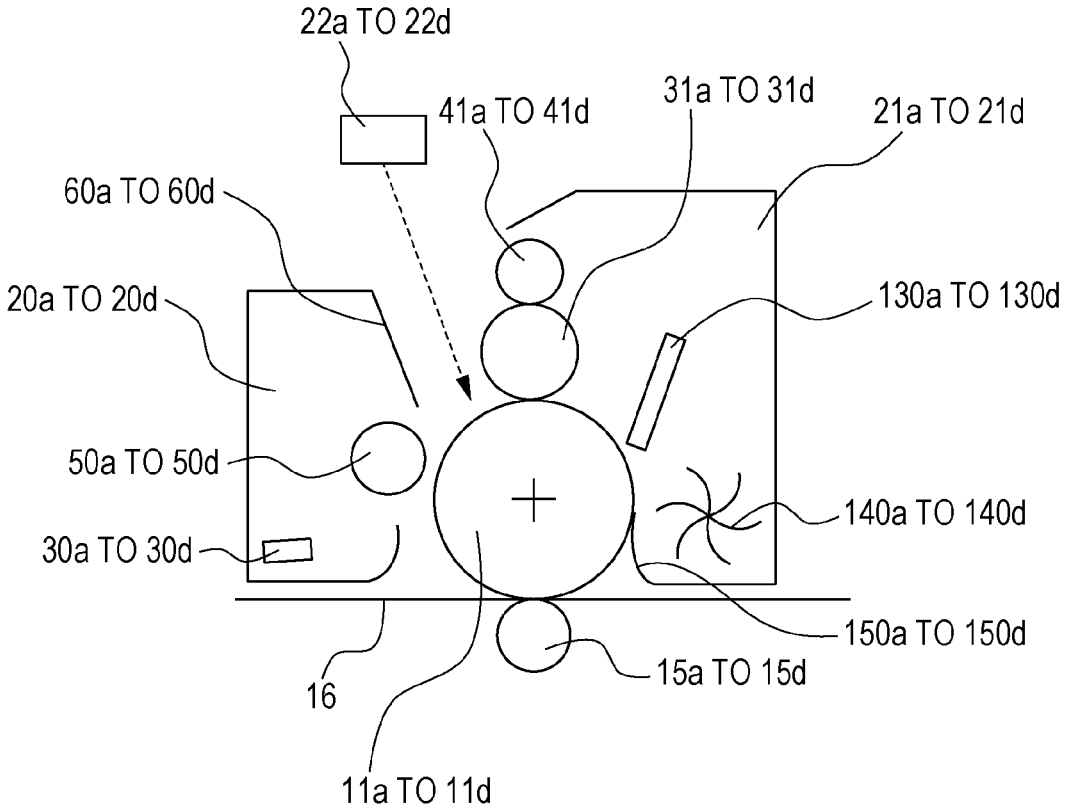
FIG. 2 is a schematic diagram of an image forming portion.

FIG. 2 is a schematic diagram of each image forming portion. The image forming portions include developing units 20*a* to 20*d* as developing devices, drum units 21*a* to 21*d*, and exposing portions 22*a* to 22*d* as exposing devices.

In the present embodiment, the developing units 20*a* to 20*d* and drum units 21*a* to 21*d* form process cartridges as units integrally attachable to and detachable from a main body of the image forming apparatus. Each of the process cartridges can be replaced with a new one in the case where a predetermined replacement time is reached or in the case where replacement is needed because of breakdown, degradation, or the like of a component included in the process cartridge.

About Drum Units 21*a* to 21*d*

The drum units 21*a* to 21*d* include photosensitive drums 11*a* to 11*d* as photosensitive members each having an outer diameter of ϕ 30 mm, charging rollers 31*a* to 31*d* as charging members for charging the photosensitive drums 11*a* to 11*d*, charging-roller cleaning members 41*a* to 41*d* as charging cleaning members for cleaning the charging rollers, cleaning blades 130*a* to 130*d* as cleaning means for cleaning toner off the surfaces of the photosensitive drums 11*a* to 11*d*, scooping sheets 150*a* to 150*d* each including an urethane sheet with a thickness of 0.1 mm to prevent the toner scraped off by the cleaning blades 130*a* to 130*d* from falling onto the intermediate transfer belt as one element in a transferring device, a toner recovery portion configured to contain the toner scraped off by the cleaning blades 130*a* to 130*d* and recovered by the scooping sheets 150*a* to 150*d*, conveyance screws 140*a* to 140*d* for conveying the toner recovered by the toner recovery portion. Among them, at least the cleaning blades 130*a* to 130*d*, scooping sheets 150*a* to 150*d*, and toner recovery portion form a cleaning portion. Each of the photosensitive drums 11*a* to 11*d* as the photosensitive members are axially supported at its center and is rotatably driven by driving means, not illustrated.

About Developing Units 20*a* to 20*d*

The developing units 20*a* to 20*d* as the developing devices include development sleeves 50*a* to 50*d* capable of being rotatably driven, each having ϕ 20 mm, and for supplying toner to electrostatic latent images formed on the photosensitive drums 11*a* to 11*d* by practical exposure performed on the photosensitive drums 11*a* to 11*d* by the exposing portions 22*a* to 22*d*, mixing screws, not illustrated here, for supplying developers including the toner to the development sleeves, regulation blades 60*a* to 60*d* for regulating the amounts of the developers on the development sleeves 50*a* to 50*d*, and developing-unit temperature sensors 30*a* to 30*d* as first temperature sensors disposed inside containing portions for containing the developers in the developing units with the aim of detecting temperatures inside the containing portions.

As each of the developing units 20*a* to 20*d* in the present embodiment, a reversal developing device of two-component magnetic brush development type is used. The two-component developer is contained in the containing portion. The two-component developer is a mixture of toner and a magnetic carrier. A two-component developer with a toner density (TD ratio) of 8% in which the toner and the carrier are mixed at a weight ratio of approximately 8:92 is used. The toner is the one in which an average particle diameter of approximately 6μ obtained by crushing and classification of a mixture in which a pigment is blended into a resin binder predominantly composed of polyester. As the carrier in a surface oxidation area, for example, a metal such as unoxidized iron, nickel, cobalt, manganese, chromium, or rear-earth metal, an alloy of such metals, oxide ferrite, or the like may suitably be used, and a method for producing these magnetic particles is not limited to a specific one. The carrier may have a volume average particle diameter of 20 to 50 μm, preferably 30 to 40 μm. The carrier may have a resistivity of 107 Ωcm or more, preferably 108 Ωcm or more.

Here, a carrier in which a core predominantly composed of ferrite is coated with a silicon resin is used. It has a volume average particle diameter of 35 μm, a resistivity of 5×108 Ωcm, and an amount of magnetization of 200 emu/cc.

The development sleeve is arranged such that it faces the photosensitive member 1*a* and is adjacent thereto in a state where a distance of closest approach to the photosensitive member 1*a* is maintained at 250 μm. The portion where the photosensitive member 1*a* and the development sleeve face each other is the developing portion.

The development sleeves 50*a* to 50*d* are driven such that their surfaces are rotated in forward directions with respect to the moving directions of the surfaces of the photosensitive drums 11*a* to 11*d* in the developing portions. Each of the development sleeves includes a magnetic roller in its inside, and the magnetic force rotates and conveys the two-component developer to the developing portion with rotation of the development sleeve.

Magnetic brush layers formed on the surfaces of the development sleeves 50*a* to 50*d* are made into predetermined thin layers by developer coating blades. A development voltage in which a direct-current voltage and an alternating-current voltage are superimposed is applied to each of the development sleeves 50*a* to 50*d* by a development voltage applying power supply as a development power supply, not illustrated.

Procedure of Image Formation

The surfaces of the photosensitive drums 11*a* to 11*d* are uniformly charged by the charging rollers 31*a* to 31*d* as the charging members to which charging voltages are applied by a charging power supply 300. Each of the charging voltages is a voltage in which a direct-current voltage and an alternating-current voltage are superimposed. After that, the photosensitive drums 11*a* to 11*d* are practically exposed by being scanned with laser beams modulated in accordance with recording image signals by the exposing portions 22*a* to 22*d* as the exposing devices, and electrostatic latent images are formed on the photosensitive drums. The electrostatic latent images are developed by the developing units 20*a* to 20*d* as the developing devices storing toner of the four colors of yellow, magenta, cyan, and black, respectively, and they are rendered visible as toner images. The toner images formed on the photosensitive drums 11*a* to 11*d* are subjected to transfer biases applied from primary transfer rollers 15*a* to 15*d* each as one element in a transferring device. The primary transfer rollers 15*a* to 15*d* are arranged in positions facing the photosensitive drums 11*a* to 11*d*, respectively, on an intermediate transfer belt 16 as one element in the transferring device. The toner images are transferred to the intermediate transfer belt 16. Through the above-described process, the toner images of the colors formed by the image forming portions corresponding to their respective colors are sequentially transferred to the intermediate transfer belt 16.

Recording materials S stored in a feeding unit 30 are retained in a predetermined feeding position by a lift plate 31, and they are fed one by one by a feeding separation unit 32. The recording material S is conveyed by a feeding conveyance unit 33. After registration is set by a registration unit 34, the recording material S is synchronized with the toner images such that it will be in a position where the toner images on the intermediate transfer belt 16 can be transferred in a secondary transfer portion described below, and it is conveyed to the secondary transfer portion.

A secondary transfer bias is applied to secondary transfer rollers 35, which are one element in the transferring device, in the secondary transfer portion, and the toner images on the intermediate transfer belt 16 are transferred to the recording material S. Then, the recording material S is conveyed by a pre-transfer conveying unit 36 to a fixing unit 37 as a fixing device. The toner images are fixed on the recording material S by being heated and pressed by the fixing unit 36. After the secondary transfer, toner, external additives, and the like remaining on the intermediate transfer belt 16 are removed by an intermediate transfer belt cleaning device 116 as intermediate transfer member cleaning means described below. In the case of a single-sided printing step, which forms a toner image on only one side of the recording material S, the recording material S is conveyed by a discharging unit 38, and it is discharged directly to a discharge tray 39. The image forming apparatus in the present embodiment can set the rotation speed of each of the intermediate transfer belt and photosensitive drums 11*a* to 11*d* to three values, 350, 290, and 175 mm/sec, depending on the type and thickness of the recording material.

The image forming apparatus includes a control portion 51 configured to control the image forming apparatus. The control portion 51 is connected to a RAM 52 for use as memory for operations, a ROM 53 storing programs executable by the control portion 51 and various kinds of data, and a backup RAM 54 for backing up obtained data and the like.

The image forming portion for each color, transferring device, and fixing device in the image forming apparatus are contained in a housing that surrounds them.

Practical exposure in the present embodiment does not include a case of a standby light emitting state where, in an energized state in which the power of a light source disposed inside the exposing device is in an ON state, the light source emits feeble light.

Temperature Sensors and their Aims

The image forming apparatus in the present embodiment includes in-device temperature-humidity sensors 3*a* to 3*d* as second temperature sensors disposed outside the process cartridges inside the housing of the main body of the image forming apparatus and development temperature sensors as first temperature sensors arranged inside the containing portions for containing the developers in the developing units. The in-device temperature-humidity sensors 3*a* to 3*d* aim at detecting environmental states of the vicinities of the image forming portions (vicinities of the charging rollers 31*a* to 31*d*), and the four in-device temperature-humidity sensors 3*a* to 3*d* are arranged in positions that face the corresponding process cartridges, respectively. The development temperature sensors 30*a* to 30*d* aim at detecting states of the developers, and the four development temperature sensors 30*a* to 30*d* are arranged inside the containing portions for containing the developers in the corresponding developing units, respectively. The in-device temperature-humidity sensors are nearer the charging members than the development sensors.

Figure 3:
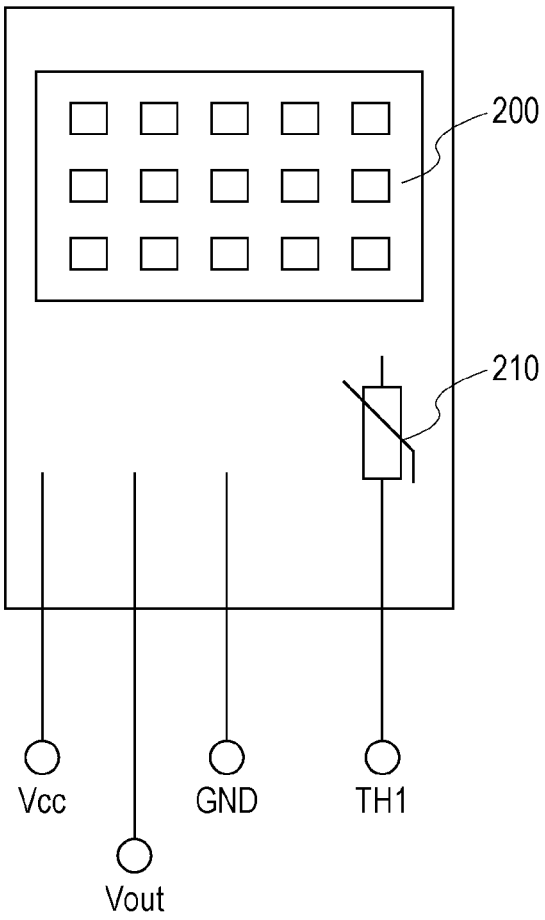
FIG. 3 is a schematic diagram of a temperature-humidity sensor.

FIG. 3 is a schematic diagram of the in-device temperature-humidity sensor in the present embodiment. It includes a humidity sensor of the high-polymer resistance change type available from Hokuriku Electric Industry Co., Ltd. (HDK) (HIS-06H-N) as humidity sensing means 200 and a chip thermistor available from Ohizumi Mfg. Co., Ltd. as temperature sensing means 21. The humidity sensing means 200 and temperature sensing means 210 are connected to a power supply terminal Vcc, output terminal Vout, earth terminal GND, and thermistor terminal TH1. The control portion 51 obtains data in accordance with various control timings and reflects them in control values. These sensing means are not limited to the above-described configurations, and other temperature-humidity sensors may also be used.

As each of the development temperature sensors 30*a* to 30*d* in the present embodiment, a sensor that includes only a chip thermistor as the temperature sensing means and does not include the humidity sensing means is used. The temperature-humidity sensor illustrated in FIG. 3 may also be used.

The in-device temperature-humidity sensors 3*a* to 3*d* are used to estimate resistance variation states of the charging rollers and set the charging voltages by detecting temperatures in the vicinities of the image forming portions, in particular, the vicinities of the charging rollers 31*a* to 31*d*.

The development temperature sensors 30*a* to 30*d* aim at detecting environments inside the containing portions for containing the developers.

Main reasons why the in-device temperature-humidity sensor and development temperature sensor are disposed for each of the image forming portions for corresponding colors are that (1) the image forming portion for yellow, which is relatively near the fixing equipment being a heat source, and the image forming portion for black, which is relatively distant from it, have different ambient temperatures, (2) the amount of toner supplied to each of the developing units varies depending on the image density of the toner image formed in image formation and the temperature in the containing portion for containing the developer including the toner changes in accordance with the temperature state of the supplied toner, and (3) the degree of a self-temperature rise caused by friction or the like occurring when the developer is circulated inside the developing unit by mixing or the like with the screw varies among the developing units.

First Adjusting Portion

The control portion 51 as a first adjusting portion calculates a relative humidity of an environment where the developer is contained from information on the temperature of the environment where the developer is contained detected by each of the development temperature sensors 30*a* to 30*d* and information on the moisture content obtained by moisture-content obtaining means as an obtaining portion other than the development temperature sensors 30*a* to 30*d* and sets a direct-current voltage value of the development voltage applied to the development sleeve and the amount of exposure by each of the exposing portions 22*a* to 22*d* based on the calculated relative humidity. By doing this, the control portion 51 sets a fogging prevention bias, which is a potential difference between a potential of an area where the toner is not to be attached in the surface of the photosensitive member (area where practical exposure is not to be performed) and the direct-current voltage value of the development voltage and sets a development contrast, which is a potential difference between a potential of an area where the toner is to be attached in the surface of the photosensitive member (area where practical exposure is to be performed) and the direct-current voltage value of the development voltage. By these settings, image stability of density and the like with various kinds of environment variations is maintained. The fogging prevention bias is set by setting the direct-current voltage value of the development voltage in the present embodiment. The invention is not limited to this case. The invention is not limited to this setting. A configuration may also be used in which the potential of the area where the toner is not to be attached in the surface of the photosensitive member (area where practical exposure is not to be performed) is set by setting the direct-current voltage value of a charging voltage applied to the charging member. In that case, the control portion 51 as first setting means sets at least one of the amount of exposure by each of the exposing portions 22*a* to 22*d*, the direct-current voltage of the charging voltage, and the direct-current voltage of the development voltage based on the development temperature sensors 30*a* to 30*d* as the first temperature sensors. As the moisture-content obtaining means, the in-device temperature-humidity sensor may also be used. The moisture-content may also be obtained by the use of another temperature-humidity sensor.

Charging Rollers

Figure 4:
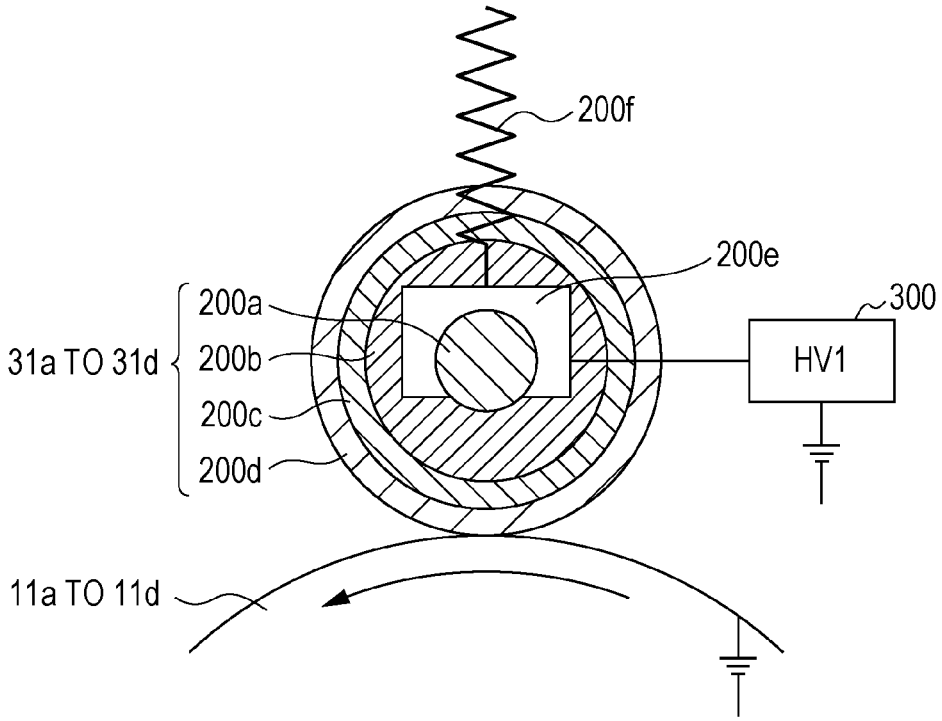
FIG. 4 is a schematic diagram of a charging roller.

The charging rollers as the charging member in the present embodiment are described below. FIG. 4 is a detailed diagram of the charging roller. In charging rollers 200*a* to 200*d*, each of both end portions of a metal core (support member) 200*a* is held by a bearing member 200*e* such that it can be freely rotated, and they are urged by a pressing spring 200*f* toward the photosensitive drums 11*a* to 11*d*. This enables the charging rollers 31*a* to 31*d* to be rotatable in a direction indicated by a curved arrow in FIG. 4 by following rotation of the photosensitive members 11*a* to 11*d*. Each of the charging rollers 31*a* to 31*d* has a longitudinal length of 330 mm and is of ϕ 14 mm. It has a three-layer structure in which a lower layer 200*b*, a middle layer 200*c*, and a surface layer 200*d* are laminated in sequence around the metal core 200*a*.

The metal core 200*a* is a stainless round bar of a diameter of 6 mm. The lower layer 200*b* is an electronic conductive layer made of ethylene propylene diene monomer (EPDM) rubber foam in which carbon is dispersed. Its specific gravity is 0.5 g/cm3, its volume resistance is $10^7$ to $10^9$ Ω·cm, and its layer thickness is approximately 3.5 mm.

The middle layer 200*c* is made of nitrile rubber (NBR) in which carbon is dispersed. Its volume resistance is $10^2$ to $10^3$ Ω·cm, and its layer thickness is approximately 500 μm. The surface layer 200*d* is an ion conductive layer in which tin oxide and carbon are dispersed in a fluorine-compound alcohol-soluble nylon resin. Its volume resistance is $10^7$ to $10^{10}$ Ω·cm, its surface roughness (JIS standard ten-point average surface roughness Rz) is 1.5 μm, and its layer thickness is approximately 5 μm. The charging roller is connected to the power supply HV1 as charge applying means configured to apply a charging voltage in which a direct-current voltage and an alternating-current voltage are superimposed.

Charging Voltage Control

Charging voltage control in the present embodiment is described below. As previously described, the charging voltage is a voltage in which a direct-current voltage and an alternating-current voltage are superimposed.

As the direct-current voltage superimposed in the charging voltage, a value corresponding to the moisture content inside the image forming apparatus (in-device moisture content) is set in consideration of the resistance variation characteristics of the charging roller. The charging voltage is set by the control portion 51 as second setting means.

FIG. 5 is a table that illustrates reference set values for the direct-current voltage superimposed in the charging voltage in the present embodiment. Values obtained by linear interpolation are set as values between the reference set values in the table. The reference set values are not limited to these settings. They can be set in accordance with the state of the image forming apparatus.

The timings of setting the direct-current voltage superimposed in the charging voltage in the present embodiment are (1) the time when the main power supply of the image forming apparatus is switched on and (2) the time when a user or repair person performs gradation correction control as required to correct density. At (1) the time when the main power supply of the image forming apparatus is switched on, toner images of a plurality of densities are formed under a plurality of development contrast conditions produced by changing the charging voltage or amount of exposure, the plurality of image densities of the toner images transferred to the intermediate transfer belt are detected by a density sensor on the intermediate transfer belt, and the density in each level in gradation is set based on the detected densities. At (2) the time when the user or repair person performs gradation correction control as required, toner images of a plurality of densities are formed under a plurality of development contrast conditions produced by changing the charging voltage or amount of exposure, the plurality of image densities of the toner images transferred and output to a recording material are detected by a density sensor, and the density in each level in gradation is set based on the detected densities.

The direct-current voltage superimposed in the charging voltage has significant influence on the image density of a toner image formed in relation to the development voltage. In the present embodiment, because the density correction control is performed in the above-described two timings, even when the direct-current voltage superimposed in the charging voltage is changed, the image density of the toner image is ensured.

The present embodiment illustrates the above-described two timings. The timings are not limited to the above-described timings. They may be any timings at which even when the direct-current voltage value in the charging voltage is changed, the image density of the toner image is secured by the density setting.

Figure 6:
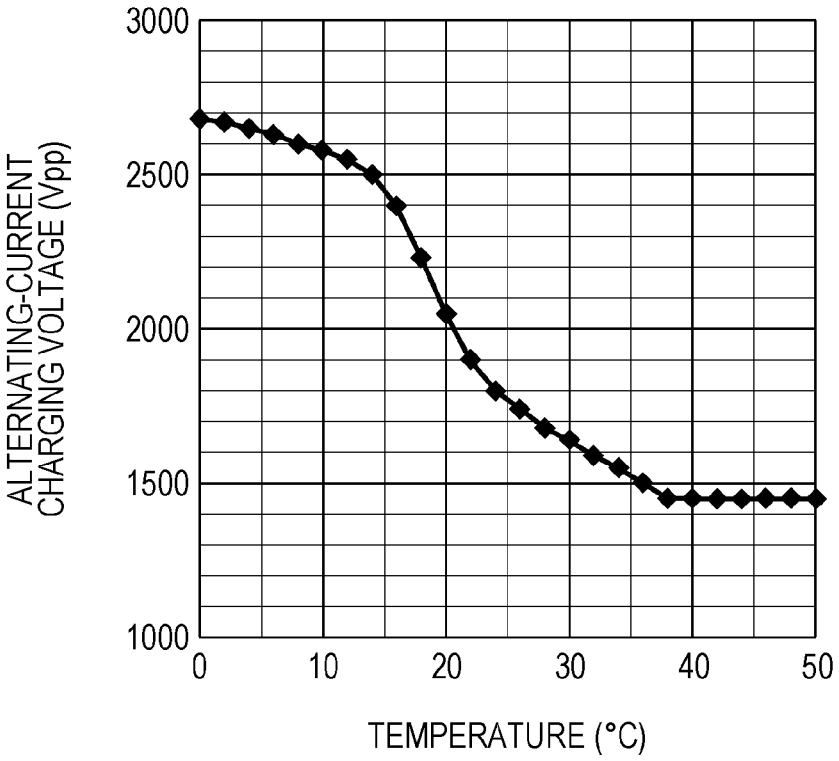
FIG. 6 is an environment table of set values of an alternating-current voltage superimposed on a charging voltage.

In contrast, as previously described, the alternating-current voltage superimposed in the charging voltage is applied with the aim of causing the charging potential of the surface of the photosensitive member to converge to the voltage value of the direct-current voltage superimposed in the charging voltage with stability. FIG. 6 is an environment table for setting a peak-to-peak voltage of the alternating-current voltage superimposed in the charging voltage in the present embodiment. The horizontal axis indicates the temperature of an atmosphere near the charging roller, and the vertical axis indicates the peak-to-peak voltage of the alternating-current voltage superimposed in the charging voltage applied to the charging roller. The charging roller used in the present embodiment has relatively large variations in the resistance value with temperature changes, and the peak-to-peak voltage of the alternating-current voltage superimposed in the charging voltage is set by setting the peak-to-peak voltage based on the temperature of the atmosphere near the charging roller. The above-described peak-to-peak voltage is set by the control portion 51 as a second adjusting portion. This is not limited to the table relating to the temperature. Depending on the characteristics of the used charging roller, the table relating to the temperature may be used in combination with a humidity table, moisture-content table, or charging-time table, and may be used in combination with all of these tables.

Examples of the timing of setting the peak-to-peak voltage of the alternating-current voltage superimposed in the charging voltage in the present embodiment may include timings when no image is formed, such as the time when the power supply of the image forming apparatus is turned on, the time of an initial rotation operation (pre-multi-rotation step) in which a predetermined preparation operation for raising a fixing temperature or the like in returning from a sleep mode is performed or the like, the time of a printing preparation rotation operation (pre-rotation step) in which a predetermined preparation operation is performed in a period after an image formation signal is input and before an image corresponding to image information is actually written, and the time for every predetermined number of sheets of image formation, for example, for every 20 sheets of image formation.

As described above, the alternating-current voltage superimposed in the charging voltage has adverse influence on the image quality of a formed toner image when the value of the peak-to-peak voltage is insufficient or excessive. Accordingly, it is useful that the peak-to-peak voltage be set at a proper value.

The temperature inside the image forming apparatus varies depending on the surface property or basis weight (thickness) of an output recoding medium, a sheet passing method, such as simplex or duplex sheet passing, or the like. The peak-to-peak voltage is set for every 20 sheets of image formation in the present embodiment because a temperature change before and after the image formation for 20 sheets inside the image forming apparatus (near the charging roller) in the present embodiment is on the order of 0.2° C. even under a severe environment, and it is determined that with the setting for every 20 sheets, the influence on the images is small. The number of sheets is not limited to this, and may be set in accordance with the characteristics of the charging roller or image forming apparatus or an environment where it is placed.

Temperature Changes with Replacement of Process Cartridge

In the image forming apparatus in the present embodiment, as previously described, the process cartridge is attachable to and detachable from the image forming apparatus, and for example, if the process cartridge reaches the end of its life and requires replacing, the process cartridge reaching the end of its life is detached from the image forming apparatus, a new process cartridge for replacement is conveyed from an external environment where it is retained, and an operation of attaching it to the image forming apparatus is performed. In this case, the temperature inside the image forming apparatus does not greatly change, but the temperature of the new process cartridge itself may widely differ from the temperature inside the image forming apparatus. Depending of the state of the operation, the temperature difference between the inside of the image forming apparatus and the process cartridge may be different by 10° C. or more. As is clear from the graph in FIG. 6, in the cases where the temperature changes by 10° C., the peak-to-peak voltage of the alternating-current voltage superimposed in the charging voltage varies by 500 V at the maximum. In the case where, under such a state, the peak-to-peak voltage of the alternating-current voltage superimposed in the charging voltage is set based on the output of the in-device temperature-humidity sensor, significantly defective charging occurs.

As previously described, the developing unit disposed in the process cartridge in the present embodiment includes the development temperature sensor as the first temperature sensor, and in replacement of the process cartridge, the development temperature sensor is also replaced together with the process cartridge. Accordingly, the temperature detected by the development temperature sensor is relatively nearer the temperature of the charging roller included in the process cartridge immediately after the new process cartridge is attached to the image forming apparatus than the temperature detected by the in-device temperature-humidity sensor. That is, in a period after the process cartridge is replaced and before the temperature of the charging roller matches with the temperature of the environment inside the image forming apparatus, it is useful that the peak-to-peak voltage of the alternating-current voltage superimposed in the charging voltage be set based on the temperature detected by the development temperature sensor.

In particular, typically, the temperature of the environment where the process cartridge is retained is lower than the temperature inside the image forming apparatus in many cases, and immediately after the replacement of the process cartridge, the temperature of the process cartridge is lower than the ambient temperature inside the image forming apparatus.

In the image forming apparatus according to the present embodiment, the control portion 51 compares a result of detection by the in-device temperature-humidity sensor and a result of detection by the development temperature sensor at the timing when it sets the peak-to-peak voltage of the alternating-current voltage superimposed in the charging voltage. In the case where the temperature detected by the development temperature sensor is lower than the temperature detected by the in-device temperature-humidity sensor, it is determined that the process cartridge has been replaced with a new one, and adjustment of the charging voltage described below is performed.

Figure 7:
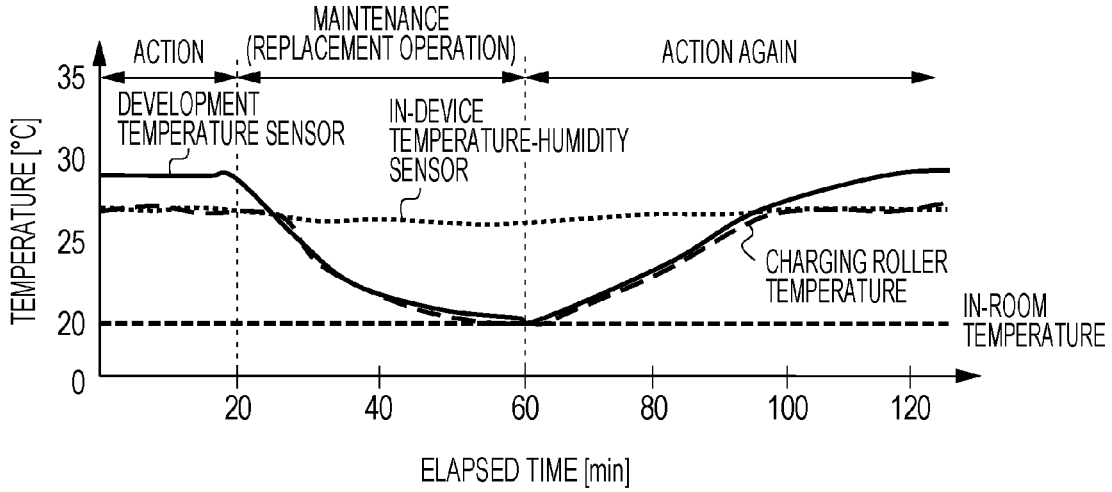
FIG. 7 is a graph that illustrates the progression of temperatures of a charging roller when a process cartridge is replaced.

FIG. 7 illustrates the progression of temperatures of the in-device temperature-humidity sensor as the second temperature sensor, of the charging roller, and of the development temperature sensor as the first temperature sensor over time in a case where a malfunction occurs during operation of the image forming apparatus and a repair person performs maintenance for approximately 40 minutes. At the time of 20 minutes in the graph, the operation of the image forming apparatus stops, and the replacement operation for the process cartridge starts. At the time of 60 minutes, the replacement operation is completed, and the operation of the image forming apparatus starts again. The graph illustrates that during stable action of the image forming apparatus, progression of the temperature of the charging roller is substantially the same as that of the in-device temperature, which is the result of detection by the in-device temperature-humidity sensor. During the replacement operation for the process cartridge, the housing of the image forming apparatus is opened in part to perform the replacement operation, the temperature of the process cartridge attached to the image forming apparatus declines until the process cartridge is detached from the image forming apparatus, the attached used process cartridge is detached, a process cartridge that has been retained in an environment whose temperatures are lower than that inside the image forming apparatus is newly attached, and therefore, the temperature of the charging roller is near the result of detection by the development temperature sensor disposed in the developing unit. After the action starts again, it substantially follows the result of detection by the development temperature sensor until it reaches the in-device temperature. After it reaches the in-device temperature, its progression is substantially the same as that of the in-device temperature.

Here, the reason why the result of detection by the development temperature sensor is higher than that by the in-device temperature-humidity sensor is that the developer rises by itself because of friction or the like in a circulation step inside the developing equipment, as previously described.

That is, in a predetermined period immediately after replacement of the process cartridge, progression of the temperature of the charging roller is substantially the same as that of a lower one of the temperature detected by the in-device temperature-humidity sensor and the temperature detected by the development temperature sensor.

Second Adjusting Portion

In the present embodiment, as previously described, the control portion 51 as the second adjusting portion adjusts the peak-to-peak voltage of the alternating-current voltage superimposed in the charging voltage applied to the charging roller.

As described above, the adjustment is performed at a predetermined timing when no image is formed, such as the time when the power supply of the image forming apparatus is turned on, the time of an initial rotation operation (pre-multi-rotation step) in which a predetermined preparation operation for raising a fixing temperature in returning from a sleep mode is performed or the like, the time of a printing preparation rotation operation (pre-rotation step) in which a predetermined preparation operation is performed in a period after an image formation signal is input and before an image corresponding to image information is actually written, and the time for each predetermined number of sheets of image formation, for example, for every 20 sheets of image formation.

In the present embodiment, as previously described, in the case where the control portion 51 compares the temperature detected by the in-device temperature-humidity sensor and that detected by the development temperature sensor at a setting timing. In the case where the temperature detected by the development temperature sensor is lower than that detected by the in-device temperature-humidity sensor, the control portion 51 as the second adjusting portion refers to the above-described temperature versus peak-to-peak voltage table and sets the peak-to-peak voltage of the alternating-current voltage superimposed in the charging voltage based on the temperature detected by the development temperature sensor as the first temperature sensor.

In the case where the temperature detected by the development temperature sensor is higher than the temperature detected by the in-device temperature-humidity sensor, the control portion 51 as the second adjusting portion sets the peak-to-peak voltage of the alternating-current voltage superimposed in the charging voltage based on the result of detection by the in-device temperature-humidity sensor.

In the present embodiment, in adjustment of the charging voltage by the second adjusting portion, temperatures detected by the in-device temperature-humidity sensor and by the development temperature sensor are used in the adjustment of the charging voltage. The invention is not limited to this configuration. The timing of detecting the temperature and the timing of setting the peak-to-peak voltage may be different.

Control Flow for Setting Charging Voltage

Figure 8:
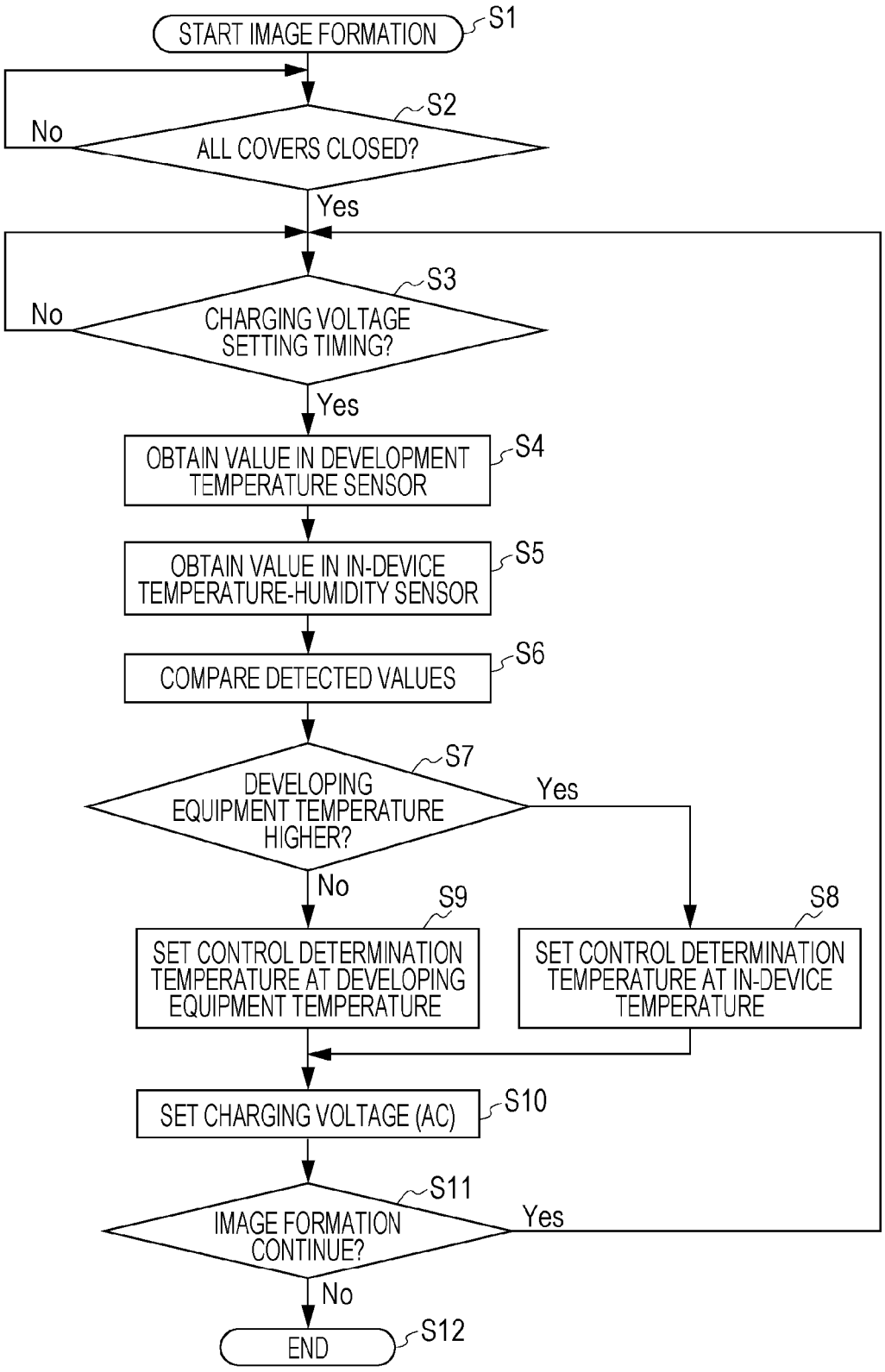
FIG. 8 illustrates a control sequence for setting a charging voltage according to a first embodiment.

FIG. 8 is a control flow for setting the peak-to-peak voltage of the alternating-current voltage superimposed in the charging voltage. The details are described below.

When a signal for starting an image forming operation is input into the image forming apparatus, control for setting the charging voltage starts (S1).

After that, it is checked whether all of the covers (not illustrated) of the housing of the image forming apparatus is closed (S2).

In the case where it is determined that they are all closed, it is determined whether the present time is a timing of setting the charging voltage (S3). As previously described, the setting timing is a predetermined timing when no image is formed. In this control flow, it is the time of pre-rotation step and the time of every 20 sheets after that.

When it is determined that the present time is the charging voltage setting timing, a detected value T1 by the development temperature sensor is obtained (S4).

Next, a detected value T2 by the in-device temperature-humidity sensor is obtained (S5).

After that, a temperature difference TΔ between the detected value T1 by the development temperature sensor and the detected value T2 by the in-device temperature-humidity sensor is calculated based on Expression (1) (S6).

$$T\Delta = T1 - T2 \quad (1)$$

Next, it is determined whether the temperature detected by the development temperature sensor is higher, that is, TΔ>0 (S7).

In the case where the temperature detected by the development temperature sensor is higher, a control determination temperature is set at the detected value by the in-device temperature-humidity sensor, and the peak-to-peak voltage of the alternating-current voltage superimposed in the charging voltage is determined based on the control determination temperature (S8).

In the case where the temperature detected by the development temperature sensor is lower than the temperature detected by the in-device temperature-humidity sensor, the control determination temperature is set at the detected value by the development temperature sensor, and the peak-to-peak voltage of the alternating-current voltage superimposed in the charging voltage is determined based on the control determination temperature (S9).

Next, the set charging voltage is applied to the charging roller, and image formation starts (S10).

After that, it is determined whether the image formation continues (S11). In the case where it is determined that the image formation is not to continue, it is determined that the image formation is to be completed, and the image formation is completed (S12).

By the above-described control, the temperature nearer a real temperature of the charging roller can be detected. This enables the charging voltage to be properly set by image formation even immediately after replacement of the process cartridge.

As described above, according to the present embodiment, the shared use of the temperature sensor disposed in the developing means in setting at least one of the amount of exposure by the exposing means, the charging voltage, and the development voltage and in setting the charging voltage can enable suppression of an increase in the cost of the process cartridge and reduction in charging unevenness in the case where the temperature of the charging member is made lower than the temperature inside the image forming apparatus by replacement of the process cartridge.

Second Embodiment

In the first embodiment, the in-device temperature-humidity sensor and the development temperature sensor include the same temperature detecting portions, that is, those with the same accuracy. However, there may be a case where the development temperature sensor with a slightly low accuracy needs to be used because of arrangement or size constraints. In the present embodiment, such a case where the in-device temperature-humidity sensor and the development temperature sensor have different temperature detecting accuracies is described. A description that overlaps with that in the first embodiment is omitted as appropriate.

Figure 9:
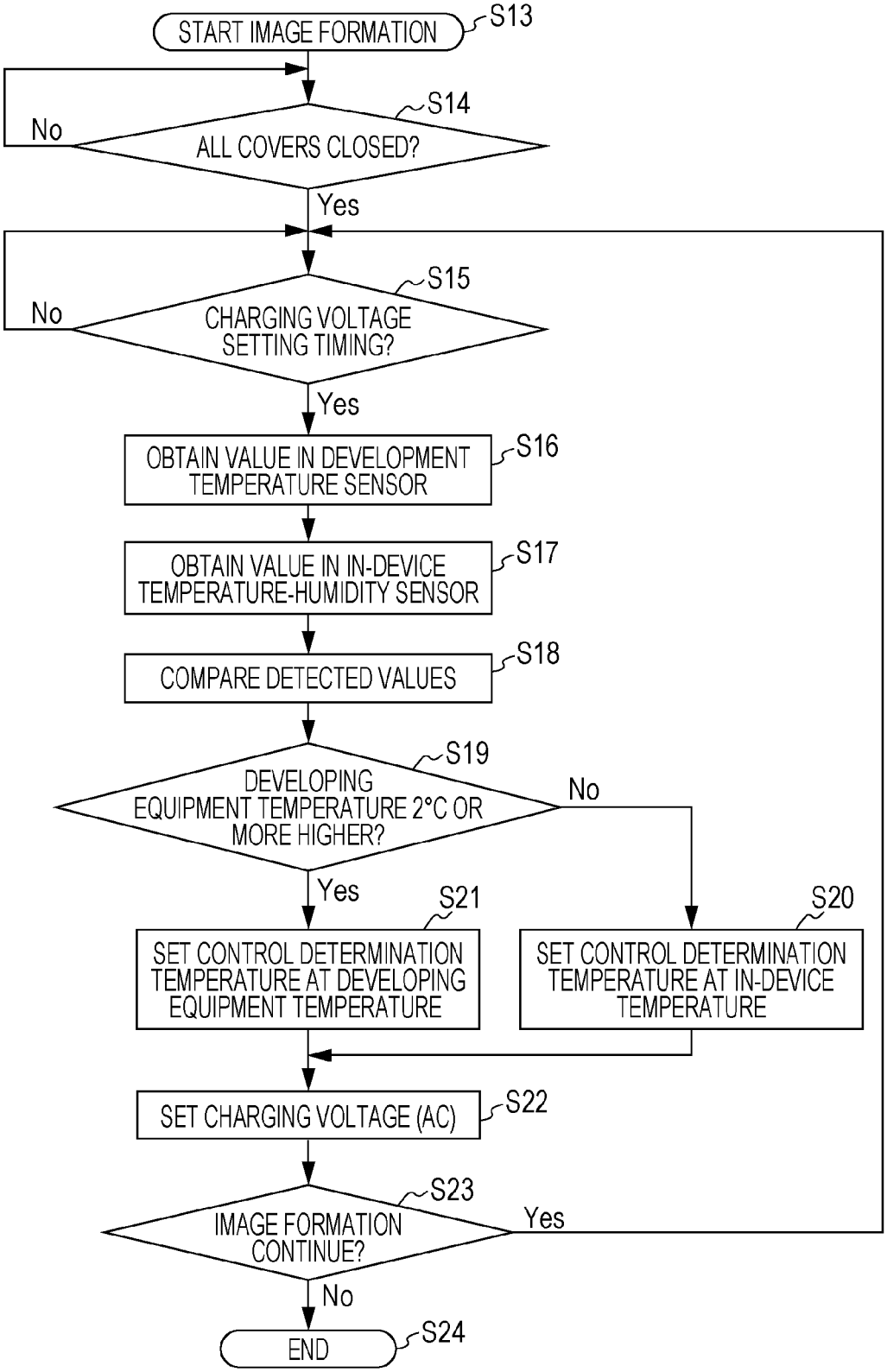
FIG. 9 illustrates a control sequence for setting a charging voltage according to a second embodiment.

In the present embodiment, control is performed such that in the case where the difference between the detected value by the in-device temperature-humidity sensor as the second temperature sensor and the detected value by the development temperature sensor as the first temperature sensor is smaller than a predetermined range, the control determination temperature is set at the detected value by the in-device temperature-humidity sensor, and the charging voltage is set based on that control determination temperature; in the case where the difference between the detected value by the in-device temperature-humidity sensor and the detected value by the development temperature sensor is larger than the predetermined range, the control determination temperature is set at the detected value by the development temperature sensor, and the charging voltage is set based on that control determination temperature. In other words, in the case where the value obtained by subtracting the temperature detected by the development temperature sensor from the temperature detected by the in-device temperature-humidity sensor is larger than a predetermined value, the charging voltage is adjusted based on the result of detection by the in-device temperature-humidity sensor; in the case where the value obtained by subtracting the temperature detected by the development temperature sensor from the temperature detected by the in-device temperature-humidity sensor is smaller than the predetermined value, the charging voltage is adjusted based on the result of detection by the in-device temperature-humidity sensor. FIG. 9 is a control flow for setting the peak-to-peak voltage of the alternating-current voltage superimposed in the charging voltage in the present embodiment. Here, in the case where the temperature detected by the development temperature sensor is 2° C. or more lower than the temperature detected by the in-device temperature-humidity sensor, the charging voltage is set based on the temperature detected by the development temperature sensor (S19 in FIG. 9).

It is useful that the set value for the temperature difference being a criterion of determination at S19 be set at a proper value depending on the accuracy of the used temperature sensor, and the value is not limited to a value of 2° C. in the present embodiment.

According to the present invention, even in the case where different sensors are used as the in-device temperature-humidity sensor and the development temperature sensor, substantially the same advantages as those in the first embodiment are obtainable.

Third Embodiment

The first and second embodiments illustrate a configuration in which the control portion 51 compares the temperature detected by the development temperature sensor as the first temperature sensor and the temperature detected by the in-device temperature-humidity sensor as the second temperature sensor.

In the present embodiment, the process cartridge includes an internal fuse in its part. The process cartridge is configured such that when the process cartridge is newly attached to the image forming apparatus, it comes into contact with sensing means disposed inside the image forming apparatus and comes into contact with sensing means disposed on the image forming apparatus side, it is energized when the power for the main body of the image forming apparatus is turned on, and the fuse is blown. The sensing means as a sensing portion senses attachment of the new process cartridge by sensing energization when the fuse is blown. Because no current flows after the fuse is blown, a process cartridge that is not new can be determined.

In the case where attachment of the new process cartridge is sensed by the sensing means, as described above, the control portion 51 as the second setting means sets the peak-to-peak voltage of the alternating-current voltage superimposed in the charging voltage based on the result of detection by the development temperature sensor as the first temperature sensor disposed in the developing unit in the process cartridge. A setting method is substantially the same as that in the first and second embodiments, and its description is omitted here.

In the present embodiment, a form is described in which the process cartridge includes the internal fuse. The invention is not limited to this form. A configuration may also be used in which the process cartridge includes recording means, such as an IC chip, that records process cartridge-specific information and the like in its part, the image forming apparatus includes a reading portion as a sensing portion that reads information in the recording means, such as the IC chip, the reading portion reads the IC chip or the like, and replacement of the process cartridge is sensed.

According to the present invention, in addition to the advantages in the first embodiment, replacement with a new process cartridge can be sensed more correctly.

Fourth Embodiment

The first to third embodiments illustrate examples in which the peak-to-peak voltage of the alternating-current voltage superimposed in the charging voltage is directly set based on a detected temperature.

In the present embodiment, a configuration is described in which discharge current control, which is described below, is performed to set the peak-to-peak voltage of the alternating-current voltage superimposed in the charging voltage.

Figure 10:
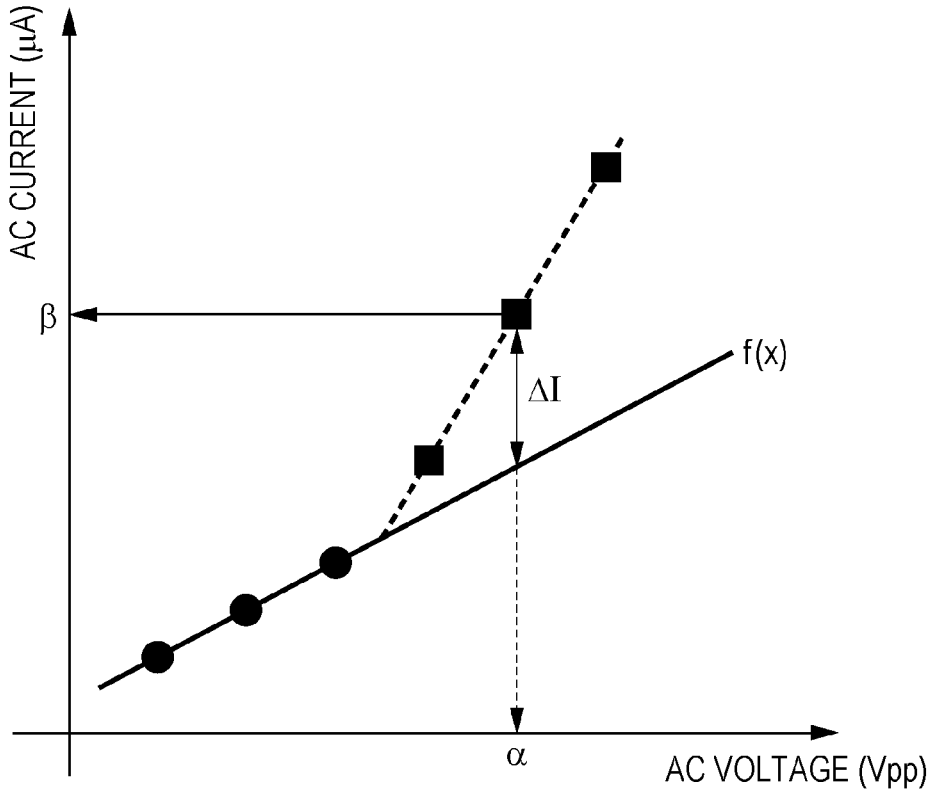
FIG. 10 illustrates a concept of controlling a discharge current according to a fourth embodiment.

First, the discharge current control is described by using FIG. 10.

In the case where an alternating-current voltage is applied between the charging roller and the photosensitive drum, in a non-discharge area based on the known Paschen's law, the alternating current flowing between the charging roller and the photosensitive drum exhibits linearity. The non-discharge area here is an area in which the peak-to-peak voltage of the alternating-current voltage is smaller than a discharge stating point, which is an absolute value of a value substantially twice a discharge starting voltage Vth, which is a voltage at which discharge starts between the charging roller and the photosensitive drum in the case where the direct-current voltage is applied to the charging roller. In the discharge current control in the present embodiment, a plurality of alternating-current test voltages having different peak-to-peak voltages in the non-discharge area and a plurality of alternating-current test voltages having different peak-to-peak voltage in a discharge area where the peak-to-peak voltage of the alternating-current voltages is at or above the absolute value of the value substantially twice the discharge starting voltage Vth are applied, and alternating currents flowing in the charging roller at that time are detected by current detecting means. When the voltage versus current characteristics obtained from the plurality of alternating-current test voltages and the alternating currents flowing at that time in the non-discharge area are linearly approximated by the least squares method, the results can be indicated as f(x) in FIG. 10. Next, from the voltage versus current characteristics obtained from the plurality of alternating-current test voltages and the alternating currents flowing at that time in the discharge area, a difference ΔI between f(x) and an alternating current when f(x) is subjected to front correction to the discharge area at the same peak-to-peak voltage is calculated. The difference ΔI is defined as the amount of the discharge current, and the peak-to-peak voltage value a whose target value is ΔI is set as the peak-to-peak voltage of the alternating-current voltage superimposed in the charging voltage. These calculation and control are performed by the control portion 51 as the second setting means.

In the above-described discharge current control, it is useful that a plurality of alternating-current test voltages be set at values near the discharge starting point as much as possible. However, as the resistance value of the charging roller varies, this discharge starting point or the characteristics of the alternating-current voltages vary, and the alternating-current test voltages may become inappropriate values, and this may result in a problem in which a peak-to-peak voltage a to obtain the target ΔI cannot be accurately calculated.

In the present embodiment, in the configuration in which the peak-to-peak voltage of the alternating-current voltage superimposed in the charging voltage is set by performing the above-described discharge current control, in the case where the temperature detected by the development temperature sensor is lower than that by the in-device temperature-humidity sensor, as described in the first and second embodiments, or in the case where replacement of the process cartridge is sensed by the sensing portion, as described in the third embodiment, the peak-to-peak voltage of the plurality of alternating-current test voltages applied to the charging roller in performing the discharge current control is set based on a result of detection by the development temperature sensor as the first temperature sensor.

According to the present embodiment, in the case where the discharge current control is performed, substantially the same advantages as those in the first embodiment are obtainable.

As described above, in the first to third embodiments, a set charging voltage is the peak-to-peak voltage of the alternating-current voltage superimposed on the direct-current voltage in the AC charging method. The invention is not limited to this setting. In the case of the DC charging method, the direct-current voltage may be set. Depending on the characteristics of the charging roller, for example, a charging frequency, a charging DC potential, a total current flowing between the charging roller and the photosensitive member, or the like may be set.

The above-described example is the one in which as the development voltage applied to the developing unit, a voltage in which a direct-current voltage and an alternating-current voltage are superimposed is used. As the development voltage, only a direct-current voltage may be applied to the development sleeve in the developing unit.

The first to fourth embodiments illustrate the configuration in which each of the image forming portions includes a single in-device temperature-humidity sensor. For example, if the in-device temperature is made substantially uniform by well-designed airflow inside the image forming apparatus, only one in-device temperature sensor may be disposed and a temperature detected by that in-device temperature sensor may be used as a temperature near each of the process cartridges.

The first to fourth embodiments illustrate the configuration in which the development temperature sensor as the first temperature sensor is arranged inside the containing portion for containing the developer. The development temperature sensor may be disposed outside the containing portion for containing the developer and in contact with an external wall of the containing portion. In this case, although the detection accuracy is slightly lower than that in the case where it is disposed inside the containing portion, the temperature of the containing portion can be detected by detection of heat propagating in the external wall of the containing portion. With this configuration, the temperature sensor does not interfere with circulation of the developer inside the containing portion.

In the present embodiments, a tandem-type image forming apparatus including a plurality of image forming portions is described. The invention is not limited to this type. A configuration that includes a single image forming portion may also be used.

The present invention is not limited to the above-described embodiments, and various changes or modifications may be made without departing from the spirit and scope of the present invention. Accordingly, the following claims are added to apprise the public of the scope of the present invention.

This application claims the benefit of Japanese Patent Application No. 2013-262770 filed Dec. 19, 2013, which is hereby incorporated by reference herein in its entirety.

REFERENCE SIGNS LIST

11*a* to 11*d* photosensitive drum
31*a* to 31*d* charging roller

3*a* to 3*d* in-device temperature-humidity sensor
30*a* to 30*d* development temperature sensor

The invention claimed is:

1. An image forming apparatus comprising:

a photosensitive member;

a charging member configured to charge the photosensitive member while being in contact with or adjacent to a surface of the photosensitive member;

an exposing device configured to expose the surface of the photosensitive member charged by the charging member and configured to form an electrostatic image thereon;

a developing device configured to develop the electrostatic image formed on the surface of the photosensitive member by the exposing device with toner and configured to form a toner image on the surface of the photosensitive member;

a transferring device configured to transfer the toner image formed on the surface of the photosensitive member by the developing device to a recording material;

a fixing device configured to fix the toner image on the recording material transferred to the recording material by the transferring device by heating and pressing the toner image;

a charging power supply configured to apply a charging voltage to the charging member;

a development power supply configured to apply a development voltage to the developing device; and a housing that houses at least the photosensitive member, the charging member, the developing device, and the fixing device therein, wherein at least the charging member and the developing device form a unit integrally attachable to and detachable from a main body of the image forming apparatus, the image forming apparatus further comprising:

a first temperature sensor disposed in the developing device and configured to detect a temperature;

a first adjusting portion configured to adjust at least one of an amount of exposure by the exposing device and the development voltage based on a result of detection by the first temperature sensor;

a second temperature sensor disposed inside the housing and configured to detect a temperature; and a second adjusting portion configured to adjust the charging voltage applied by the charging power supply, wherein the second adjusting portion is configured to adjust the charging voltage based on the result of detection by the first temperature sensor in a case where the temperature detected by the first temperature sensor is lower than the temperature detected by the second temperature sensor and configured to adjust the charging voltage based on a result of detection by the second temperature sensor in a case where the temperature detected by the first temperature sensor is higher than the temperature detected by the second temperature sensor.

2. The image forming apparatus according to claim 1, wherein the charging voltage is a voltage in which a direct-current voltage and an alternating-current voltage are superimposed, and the second adjusting portion adjusts a peak-to-peak voltage of the alternating-current voltage.

3. The image forming apparatus according to claim 1, wherein the second adjusting portion adjusts the peak-to-peak voltage to a first peak-to-peak voltage in a case where the result of detection by the first temperature sensor or the second temperature sensor used in the adjustment of the charging voltage is a first temperature and adjusts the peak-to-peak voltage to a second peak-to-peak voltage being larger than the first peak-to-peak voltage in a case where the result of detection by the first temperature sensor or the second temperature sensor used in the adjustment of the charging voltage is a second temperature being lower than the first temperature.

4. The image forming apparatus according to claim 1, wherein the second temperature sensor is nearer the charging member than the first temperature sensor.

5. The image forming apparatus according to claim 1, further comprising an obtaining portion configured to obtain information on a moisture content inside the image forming apparatus, wherein the first adjusting portion adjusts at least one of the amount of exposure by the exposing device and the development voltage based on the result of detection by the first temperature sensor and the information on the moisture content obtained by the obtaining portion.

6. The image forming apparatus according to claim 1, wherein the developing equipment includes a containing portion for containing the toner, and the first temperature sensor is in contact with an outer side of the containing portion.

7. The image forming apparatus according to claim 1, wherein the charging voltage is a direct-current voltage, and the second adjusting portion adjusts a voltage value of the direct-current voltage.

8. An image forming apparatus comprising:

a photosensitive member;

a charging member configured to charge the photosensitive member while being in contact with or adjacent to a surface of the photosensitive member;

an exposing device configured to expose the surface of the photosensitive member charged by the charging member and configured to form an electrostatic image thereon;

a developing device configured to develop the electrostatic image formed on the surface of the photosensitive member by the exposing device with toner and configured to form a toner image on the surface of the photosensitive member;

a transferring device configured to transfer the toner image formed on the surface of the photosensitive member by the developing device to a recording material;

a fixing device configured to fix the toner image on the recording material transferred to the recording material by the transferring device by heating and pressing the toner image;

a charging power supply configured to apply a charging voltage to the charging member;

a development power supply configured to apply a development voltage to the developing device; and a housing that houses at least the photosensitive member, the charging member, the developing device, and the fixing device therein, wherein at least the charging member and the developing device form a unit integrally attachable to and detachable from a main body of the image forming apparatus, the image forming apparatus further comprising:

a first temperature sensor disposed in the developing device and configured to detect a temperature;

a first adjusting portion configured to adjust at least one of an amount of exposure by the exposing device and the development voltage based on a result of detection by the first temperature sensor;

a second temperature sensor disposed inside the housing and configured to detect a temperature; and a second adjusting portion configured to adjust the charging voltage applied by the charging power supply, wherein the second adjusting portion is configured to adjust the charging voltage based on the result of detection by the first temperature sensor in a case where a value obtained by subtracting the temperature detected by the first temperature sensor from the temperature detected by the second temperature sensor is larger than a predetermined value and configured to adjust the charging voltage based on a result of detection by the second temperature sensor in a case where the value obtained by subtracting the temperature detected by the first temperature sensor from the temperature detected by the second temperature sensor is smaller than the predetermined value.

9. The image forming apparatus according to claim 8, wherein the charging voltage is a voltage in which a direct-current voltage and an alternating-current voltage are superimposed, and the second adjusting portion adjusts a peak-to-peak voltage of the alternating-current voltage.

10. The image forming apparatus according to claim 8, wherein the second adjusting portion adjusts the peak-to-peak voltage to a first peak-to-peak voltage in a case where the result of detection by the first temperature sensor or the second temperature sensor used in the adjustment of the charging voltage is a first temperature and adjusts the peak-to-peak voltage to a second peak-to-peak voltage being larger than the first peak-to-peak voltage in a case where the result of detection by the first temperature sensor or the second temperature sensor used in the adjustment of the charging voltage is a second temperature being lower than the first temperature.

11. The image forming apparatus according to claim 8, wherein the second temperature sensor is nearer the charging member than the first temperature sensor.

12. The image forming apparatus according to claim 8, further comprising an obtaining portion configured to obtain information on a moisture content inside the image forming apparatus, wherein the first adjusting portion adjusts at least one of the amount of exposure by the exposing device and the development voltage based on the result of detection by the first temperature sensor and the information on the moisture content obtained by the obtaining portion.

13. The image forming apparatus according to claim 8, wherein the developing equipment includes a containing portion for containing the toner, and the first temperature sensor is in contact with an outer side of the containing portion.

14. The image forming apparatus according to claim 8, wherein the charging voltage is a direct-current voltage, and the second adjusting portion adjusts a voltage value of the direct-current voltage.

15. An image forming apparatus comprising:

a photosensitive member;

a charging member configured to charge the photosensitive member while being in contact with or adjacent to a surface of the photosensitive member;

an exposing device configured to expose the surface of the photosensitive member charged by the charging member and configured to form an electrostatic image thereon;

a developing device configured to develop the electrostatic image formed on the surface of the photosensitive member by the exposing device with toner and configured to form a toner image on the surface of the photosensitive member;

a transferring device configured to transfer the toner image formed on the surface of the photosensitive member by the developing device to a recording material;

a fixing device configured to fix the toner image on the recording material transferred to the recording material by the transferring device by heating and pressing the toner image;

a charging power supply configured to apply a charging voltage to the charging member;

a development power supply configured to apply a development voltage to the developing device; and a housing that houses at least the photosensitive member, the charging member, the developing device, and the fixing device therein, wherein at least the charging member and the developing device form a unit integrally attachable to and detachable from a main body of the image forming apparatus, the image forming apparatus further comprising:

a first temperature sensor disposed in the developing device and configured to detect a temperature;

a first adjusting portion configured to adjust at least one of an amount of exposure by the exposing device and the development voltage based on a result of detection by the first temperature sensor;

a second temperature sensor disposed inside the housing and configured to detect a temperature;

a second adjusting portion configured to adjust the charging voltage applied by the charging power supply; and a sensing portion configured to sense replacement of the unit, wherein the second adjusting portion is configured to adjust the charging voltage based on the result of detection by the first temperature sensor in a case where the replacement of the unit is sensed by the sensing portion and configured to adjust the charging voltage based on a result of detection by the second temperature sensor in a case where the replacement of the unit is not sensed.

16. The image forming apparatus according to claim 15, wherein the charging voltage is a voltage in which a direct-current voltage and an alternating-current voltage are superimposed, and the second adjusting portion adjusts a peak-to-peak voltage of the alternating-current voltage.

17. The image forming apparatus according to claim 15, wherein the second adjusting portion adjusts the peak-to-peak voltage to a first peak-to-peak voltage in a case where the result of detection by the first temperature sensor or the second temperature sensor used in the adjustment of the charging voltage is a first temperature and adjusts the peak-to-peak voltage to a second peak-to-peak voltage being larger than the first peak-to-peak voltage in a case where the result of detection by the first temperature sensor or the second temperature sensor used in the adjustment of the charging voltage is a second temperature being lower than the first temperature.

18. The image forming apparatus according to claim 15, wherein the second temperature sensor is nearer the charging member than the first temperature sensor.

19. The image forming apparatus according to claim 15, further comprising an obtaining portion configured to obtain information on a moisture content inside the image forming apparatus, wherein the first adjusting portion adjusts at least one of the amount of exposure by the exposing device and the development voltage based on the result of detection by the first temperature sensor and the information on the moisture content obtained by the obtaining portion.

20. The image forming apparatus according to claim 15, wherein the developing equipment includes a containing portion for containing the toner, and the first temperature sensor is in contact with an outer side of the containing portion.

21. The image forming apparatus according to claim 15, wherein the charging voltage is a direct-current voltage, and the second adjusting portion adjusts a voltage value of the direct-current voltage.

* * * * *